US007658509B2

(12) United States Patent
Summers et al.

(10) Patent No.: US 7,658,509 B2
(45) Date of Patent: Feb. 9, 2010

(54) SOLID-STATE STRIP LIGHTING SYSTEM FOR ASSEMBLY EFFICIENCY AND VARIABLE BEAM ANGLE WITH INTEGRAL HEATSINK

(75) Inventors: Paul L. Summers, Troy, OH (US); Mark E. Poling, Springfield, OH (US); William H. Tyson, Urbana, OH (US); Leonard De Oto, Springfield, OH (US)

(73) Assignee: Honeywell International Inc., Morristown, NJ (US)

( * ) Notice: Subject to any disclaimer, the term of this patent is extended or adjusted under 35 U.S.C. 154(b) by 82 days.

(21) Appl. No.: 11/559,692

(22) Filed: Nov. 14, 2006

(65) Prior Publication Data

US 2008/0112161 A1 May 15, 2008

(51) Int. Cl.
*F21S 4/00* (2006.01)

(52) U.S. Cl. ..... 362/249; 362/249.04; 362/225; 362/218; 362/219; 362/235

(58) Field of Classification Search ..... 362/225, 362/252, 217, 219, 224, 235, 239, 240, 222, 362/227

See application file for complete search history.

(56) References Cited

U.S. PATENT DOCUMENTS

| | | | | |
|---|---|---|---|---|
| 4,006,396 | A * | 2/1977 | Bogut | 320/125 |
| 5,628,557 | A * | 5/1997 | Huang | 362/252 |
| 6,776,504 | B2 * | 8/2004 | Sloan et al. | 362/240 |
| 6,796,680 | B1 * | 9/2004 | Showers et al. | 362/246 |
| 7,033,060 | B2 * | 4/2006 | Dubuc | 362/600 |
| 7,140,751 | B2 * | 11/2006 | Lin | 362/250 |
| 2002/0114155 | A1 * | 8/2002 | Katogi et al. | 362/219 |
| 2005/0168999 | A1 * | 8/2005 | Sommers et al. | 362/427 |
| 2005/0201098 | A1 * | 9/2005 | DiPenti et al. | 362/294 |
| 2005/0270774 | A1 | 12/2005 | Pan | |
| 2006/0146531 | A1 * | 7/2006 | Reo et al. | 362/244 |
| 2007/0047229 | A1 * | 3/2007 | Lee | 362/237 |
| 2007/0081332 | A1 * | 4/2007 | He | 362/252 |

FOREIGN PATENT DOCUMENTS

| | | | |
|---|---|---|---|
| WO | WO2006/044739 | A | 4/2004 |
| WO | WO2005/024291 | A | 3/2005 |
| WO | WO2005/088190 | A | 9/2005 |

* cited by examiner

*Primary Examiner*—Sandra L O'Shea
*Assistant Examiner*—Evan Dzierzynski
(74) *Attorney, Agent, or Firm*—Black Lowe & Graham, PLLC

(57) ABSTRACT

A solid-state light emitting device strip lighting system. The system includes an elongated fixture, a reflector, and a strip including a plurality of solid-state light emitting devices electrically connected in series disposed along the fixture. A heat sink and/or the reflector is formed as an integral part of the elongated fixture. In one aspect of the invention, a beam angle of the plurality of light emitting devices perpendicular to the long axis of the elongated fixture is adjustable by varying the height of the strip containing the devices. In an additional aspect of the invention, at least one end cap is connected to the strip containing the devices in such a way that an external power converter and/or controller may be connected to the end cap to power and/or control the devices. These strip lights are daisy chainable in series, eliminating the need for multiple drops of AC supply wiring.

17 Claims, 5 Drawing Sheets

SOLID-STATE STRIP LIGHTING SYSTEM FOR ASSEMBLY EFFICIENCY AND VARIABLE BEAM ANGLE WITH INTEGRAL HEATSINK

BACKGROUND OF THE INVENTION

Strip lighting systems using fluorescent lights exist, but they are limited by the omnidirectional and less efficient radiation nature of fluorescent tubes in comparison to the unidirectional and more efficient nature of solid-state light emitting devices such as Light Emitting Diode (LED) devices with particular beam angles. Strip lighting systems using LEDs also exist, but they suffer from a number of limitations. Individual luminaires of such systems are cost constrained and limited in length by the type of circuit boards used to power the LEDs. A typical printed circuit board (PCB) material, FR-4, has a maximum practical length of approximately 22 inches, and producing luminaires of longer lengths typically requires the use of multiple PCB sub-boards. This results in increased cost and manufacturing complexity (due to interfaces and connectors). Use of PCBs also does not easily allow for the production of luminaires at a variety of lengths on demand. Separate heat sinks and reflectors are also typically required, thus increasing the cost of such systems. Additionally, current systems employ dedicated controllers and power supplies that are included within each luminaire, thus increasing manufacturing cost. Current systems also do not allow for adjustment of the beam angle provided by the luminaires Accordingly, there is a need for an easy to manufacture, low cost solid-state light emitting device strip lighting system.

SUMMARY OF THE INVENTION

The present invention provides a solid-state light emitting device strip lighting system. An example system includes an elongated fixture, a reflector, and a strip including a plurality of solid-state light emitting devices electrically connected in series disposed along the length of the elongated fixture. In an example embodiment, the strip is made of flex circuitry that can be cut to a desired length and the solid-state light emitting devices are Light Emitting Diodes (LEDs). In one aspect of the invention, a heat sink and/or the reflector is formed as an integral part of the elongated fixture. In an additional aspect of the invention, the elongated fixture serves as a heat sink for heat generated by the plurality of LEDs. In accordance with still further aspects of the invention, a beam angle of the plurality of LEDs perpendicular to the long axis of the elongated fixture is adjustable by varying the height of the strip containing the LEDs through the use of a riser, for example. In accordance with yet other aspects of the invention, at least one end cap is connected to the strip containing the LEDs in such a way that an external power converter and/or controller may be connected to the end cap to power and/or control the LEDs.

As will be readily appreciated from the foregoing summary, the invention provides a solid-state light emitting device strip lighting system that does not require a separate heat sink and/or reflector. The invention also provides a solid-state light emitting device strip lighting system that can be easily produced at a variety of lengths. The invention further provides a solid-state light emitting device strip lighting system that provides for a beam angle adjustment. Additionally, the invention provides a solid-state light emitting device strip lighting system that can be connected to an external power converter and/or controller, thus reducing the number of parts and allowing more cost effective production techniques to be used.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
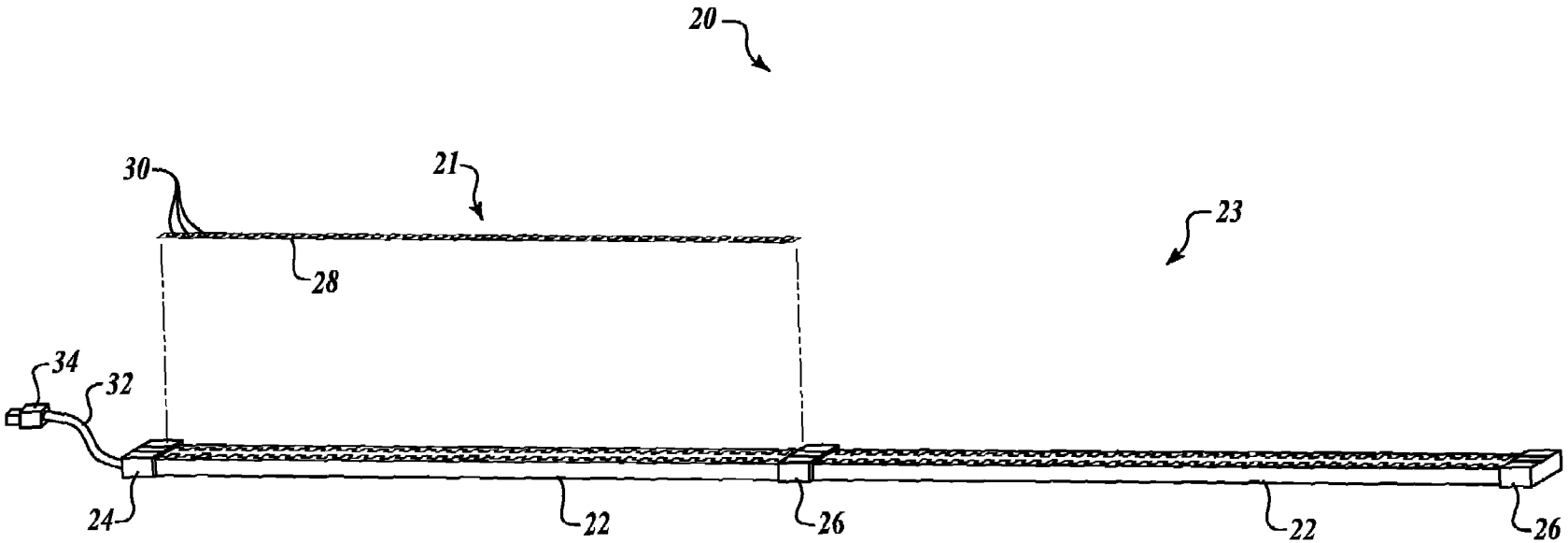
FIG. 1 is diagram of a perspective view of a solid-state light emitting device strip lighting system in accordance with an embodiment of the invention.

FIG. 1 is a diagram of a solid-state light emitting device strip lighting system 20 formed in accordance with an example embodiment of the invention. In this embodiment, the solid-state light emitting devices are standard cool white Light Emitting Diodes (LEDs). However, it should be understood that the solid-state light emitting devices are LEDs of other colors or emission spectra, LEDs having specific beam angles, Organic Light Emitting Diodes (OLEDs), nanostructure LEDs, narrow band laser-type LEDs, and/or other types of solid-state light emitting devices in other embodiments. The strip lighting system 20 includes a first luminaire 21 and a second luminaire 23. However, other embodiments include different numbers of luminaires. The first luminaire 21 includes an elongated fixture 22 having first and second ends, a first end cap 24 attached to the first end of the elongated fixture 22, and a second end cap 26 having first and second sides, the first side attached to the second end of the elongated fixture 22. In this embodiment, the first end cap 24 is structured to accept a connecting cable and the second end cap 26 is structured to be a daisy-chaining end cap that can either be a final end cap in a string of luminaires or be placed between two luminaires. Luminaires then interconnect directly, or in another embodiment have a flexible cable as the interconnection. In this embodiment an interconnecting strip 28 is located along an interior surface of the elongated fixture 22. A plurality of LEDs 30 are spaced along the length of the interconnecting strip 28 and are electrically connected in series using conductive traces (See FIG. 4) included as a part of the interconnecting strip 28. The interconnecting strip 28 is a polyethylene naphthalate (PEN) flex circuit in some embodiments, for example, such as that produced by Sheldahl/Multek Flexible Circuits. The interconnecting strip 28 includes electrically conductive traces (See FIG. 4) that connect the plurality of LEDs 30 to a first end of the first end cap 24. In this embodiment a cable 32 is connected at one end to a second end of the first end cap 24 and includes a connector 34 on the other end. The connector 34 is connectable to a direct current (DC) power converter, an alternating current (AC) power source, an external controller, and/or an end cap of an additional elongated fixture (all not shown) in some embodiments. An example of the connector 34 is the Amp Micro Mate-n-Lok® connector. The second luminaire 23 includes an elongated fixture 36 that is substantially identical to the elongated fixture 22, an interconnecting strip (not shown), and a plurality of LEDs (not shown). The first end of the elongated fixture 36 is attached to a second side of the second end cap 26. The second end of the elongated fixture 36 is attached to a third end cap 38 that is substantially identical to the second end cap 26.

Although the interconnecting strip 28 is used in this embodiment, other embodiments use silk-screen printed circuitry that is printed directly onto the elongated fixture 22, with the LEDs 30 being electrically connected to the silk-screen printed circuitry. Still other embodiments might silk-screen or print the circuitry on the reflector or heatsink (fixture 22) surfaces, such as on an aluminum Anotherm substrate by TT Electronics IRC Advanced Film Division, for example. In some embodiments, a diffuser and/or lens (not shown) are attached to the elongated fixture 22 above the LEDs 30. The diffuser and/or lens is made of a polymeric plastic material in some embodiments. In some embodiments, many of the components of the invention are formed by 'continuous form' production processes. This allows the components to be manufactured at a variety of specified lengths to accommodate different applications. In some embodiments, such components include the fixture (enclosure), the interconnecting strip (flex circuitry) with the LEDs, the plastic diffuser and/or the lens. The luminaires 21, 23 can accordingly vary in length from a couple of inches to the limits of the fabrication process for making the elongated fixture 22 and/or the other components.

Figure 2A:
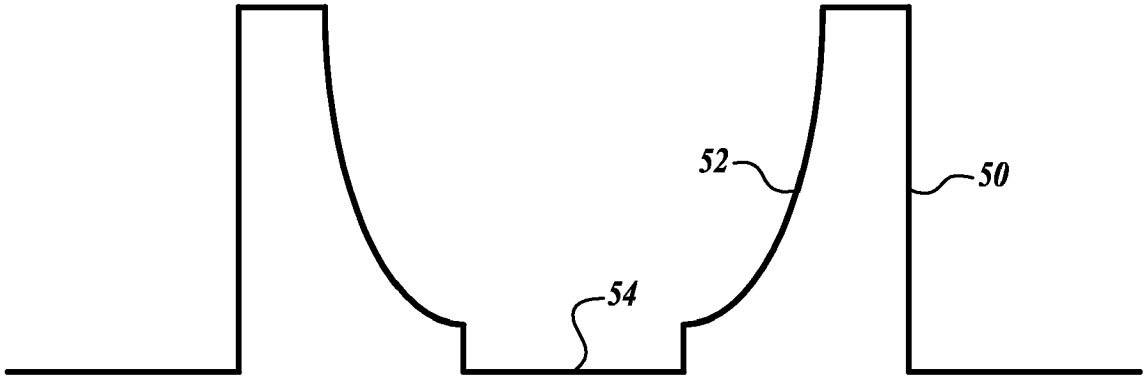
FIGS. 2A through 3D are diagrams showing cross-sectional views of example embodiments of a component shown in FIG. 1.
Figure 2C:
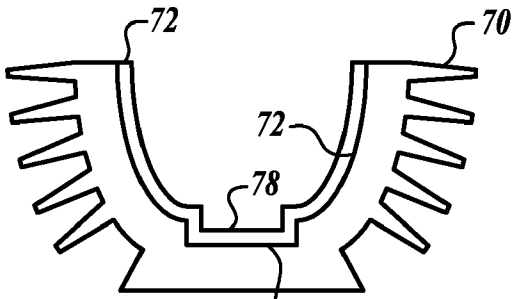
Figure 2B:
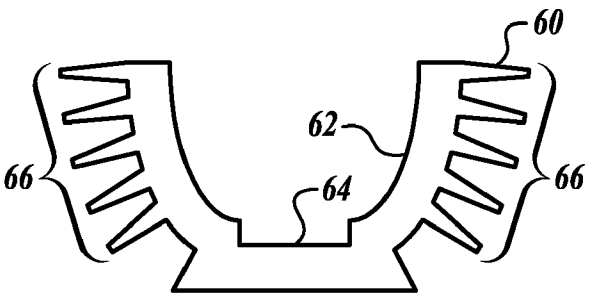

FIGS. 2A and 2B are diagrams showing cross-sectional views of example embodiments of the elongated fixture 22 shown in FIG. 1. FIG. 2A shows a bent sheet metal fixture 50 that is used as the elongated fixture 22 in some embodiments. The bent sheet metal fixture 50 includes an inner surface 52 that is used as a reflector in some embodiments. The bent sheet metal fixture 50 also includes a floor 54 to which the interconnecting strip 28 is attached in some embodiments. The floor 54 of the bent sheet metal fixture 50 is referred to as being a floor for convenience and ease of description. However, in many cases, the elongated fixture 22 will actually be mounted in such a way that the floor 54 will be above the interconnecting strip 28 or on one side of the interconnecting strip 28 rather than being beneath it.

FIG. 2B shows an extruded fixture 60 that is used as the elongated fixture 22 in some embodiments. The extruded fixture 60 is metal in some embodiments, such as those that require heat-sinking for example. This allows a lower part-count and decreased cost in comparison to previous solid-state lighting technologies. In previous technologies, LEDs are attached to a separate heat sink, which is in turn contained within an enclosure. The present invention integrates the heat sink and enclosure into a single low-weight, low-cost component. The extruded fixture 60 is formed by extruding a metal, such as aluminum and/or magnesium through a mold in some embodiments. However, the extruded fixture 60 is made of polymeric material in some embodiments, such as those that do not require significant heat sinking by the elongated fixture 22.

The extruded fixture 60 includes an inner surface 62 that is used as a reflector in some embodiments. The inner surface 62 is polished and/or anodized to enhance its use as a reflector in some embodiments. Using the extruded fixture 60 as the reflector itself rather than using a separate reflector is advantageous because it reduces non-recurring engineering costs, component count, manufacturing assembly complexities, and overall cost. The fixture 60 interior is formed in the shape of a reflector cup. By using a parabolic shaped interior, the fixture functions as a relatively efficient reflector. The extruded fixture 60 also includes a floor 64 to which the interconnecting strip 28 is attached in some embodiments. In addition, the extruded fixture 60 includes a plurality of fins 66 that help dissipate heat generated by the LEDs 30. FIG. 2C shows an extruded fixture 70 that includes an inner surface 72 and a floor 74. A reflector 76 is located along the inner surface 72. The reflector 76 also includes an inner surface and a floor 78. The reflector 76 may be made of electro-polished, polished and anodized, or reflective powder coated aluminum, for example. In other embodiments, the reflector 76 may be made of metallized plastic or be a metallized mylar sheet that is attached by an adhesive, a pressure fit, or an attachment device such as a screw or rivet.

Figure 3A:
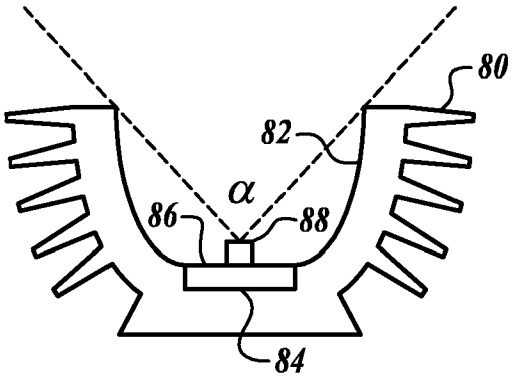

FIGS. 3A through 3D are diagrams showing cross-sectional views of example embodiments of the elongated fixture shown in FIG. 1 that allow for LED beam angle adjustment. FIG. 3A shows an extruded fixture 80 that includes a reflective inner surface 82 and a floor 84. An interconnecting strip 86 including LEDs 88 is attached to the floor 84 of the extruded fixture 80. Positioning of the LEDs 88 by running the interconnecting strip 86 along the floor 84 in this fashion allows light from the LEDs 88 to exit the extruded fixture 80 with a beam angle $\alpha$. The beam angle $\alpha$ is determined by considering only light emitted directly from the LEDs 88 rather than light from the LEDs 88 that is first reflected by the inner surface 82 before exiting the extruded fixture 80.

Figure 3B:
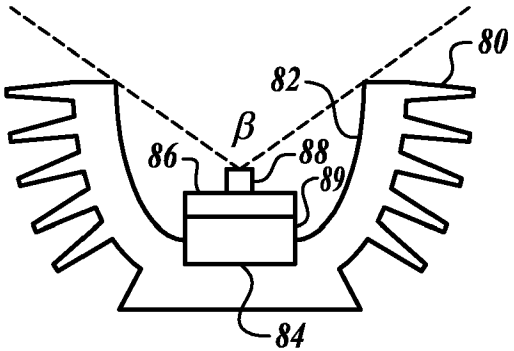

FIG. 3B shows the extruded fixture 80, interconnecting strip 86, and LEDs 88 shown in FIG. 3A, but also includes a riser 89 that is positioned between the floor 84 and the interconnecting strip 86. The riser 89 is attached to the floor 84. The interconnecting strip 86 is attached to the riser 89. Use of the riser 89 shifts the location of the interconnecting strip 86 above the floor 84 of the extruded fixture 80. In comparison with the beam angle $\alpha$, this increases the LED beam angle to an angle $\beta$ that exits the extruded fixture 80. In other embodiments, risers with heights that differ from the riser 89 are used which produce still other beam angles that exit the extruded fixture 80. In some embodiments, selection and installation of a riser with a height that will result in a desired beam angle is performed at the time the strip lighting system is installed, rather than having a single fixed beam angle being predetermined at the time of manufacture.

Figure 3C:
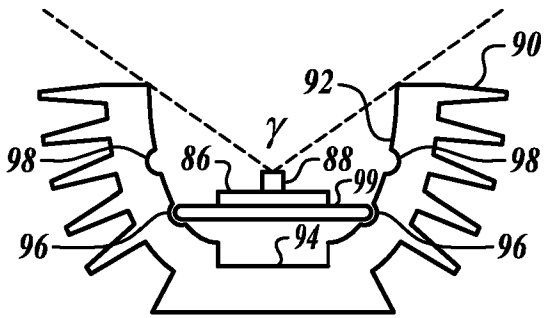

FIG. 3C shows an extruded fixture 90 that includes an inner surface 92 and a floor 94. The inner surface 92 is formed such that a first set of indentations 96 and a second set of indentations 98 run longitudinally along the inner surface 92. A riser 99 snaps into place within the first set of indentations 96 in this example embodiment. However, in other embodiments, a riser of suitable size snaps into the second set of indentations 98 rather than the first set of indentations 96. The interconnecting strip 86 is attached to the top of the riser 99. The riser 99 holds the interconnecting strip 86 above the floor 94 of the extruded fixture 90 which increases the LED beam angle leaving the extruded fixture 90 to an angle $\gamma$.

Figure 3D:
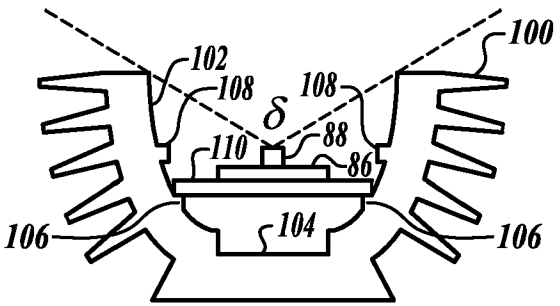

FIG. 3D also shows a structure that allows for differing beam angles, but that uses protrusions 106, 108 rather than indentations to support a riser 110. An extruded fixture 100 includes an inner surface 102 and a floor 104. The inner surface 102 is formed such that the first set of protrusions 106 and the second set of protrusions 108 run longitudinally along the inner surface 102. The riser 110 is attached using an adhesive to the first set of protrusions 106 in this example embodiment. However, in other embodiments, a riser of suitable size is attached to the second set of protrusions 108 rather than the first set of protrusions 106. The interconnecting strip 86 is attached to the top of the riser 110. The riser 110 holds the interconnecting strip 86 above the floor 104 of the extruded fixture 100 which increases the LED beam angle leaving the extruded fixture 100 to an angle δ.

Although only three structures have been shown that increase the LED beam angle leaving the strip light system 20, other structures are used in other embodiments. For example, rather than using first and second sets of indentations 96, 98 or first and second sets of protrusions 106, 108, intermittent, longitudinally spaced apart indentations or protrusions that do not run the entire length of the extruded fixtures 90, 100 are used in other embodiments along with suitably formed risers that are snapped into the intermittent indentations or attached to the intermittent protrusions.

Figure 4:
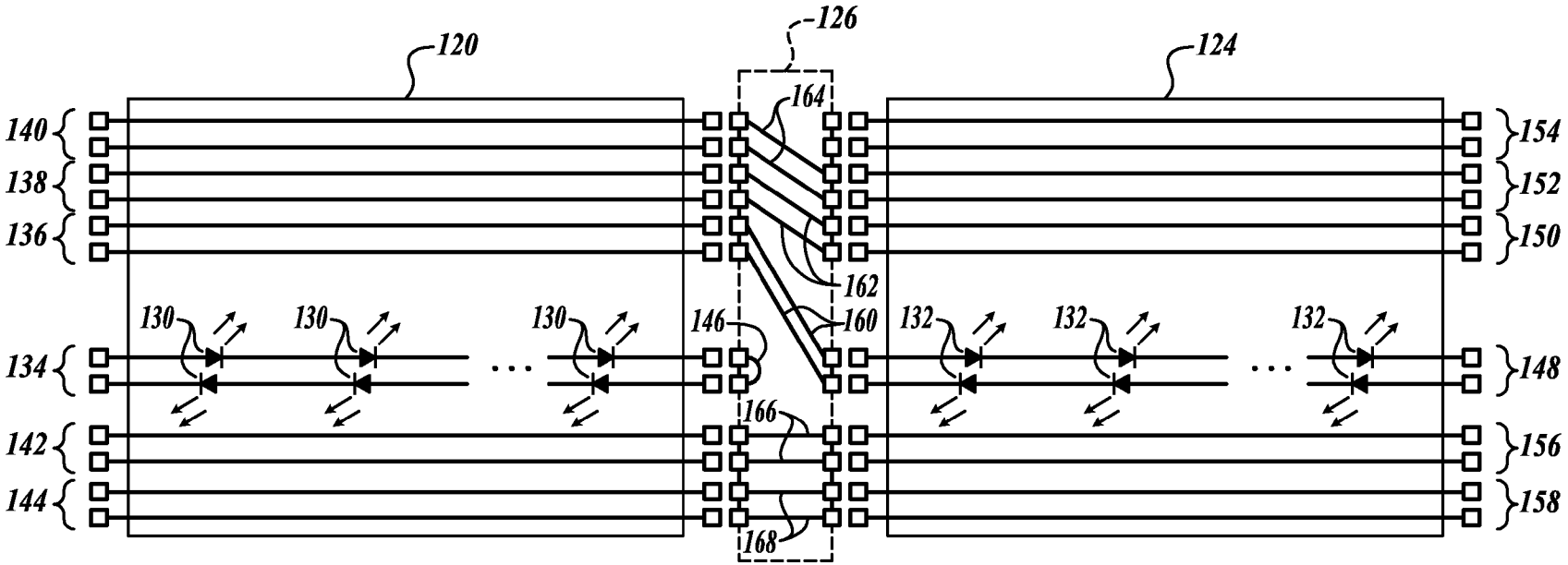
FIG. 4 is a diagram showing a schematic view of how two interconnecting strips are connected in an example embodiment of the invention.

FIG. 4 is a diagram showing a schematic view of the way two interconnecting strips are connected in an example embodiment of the invention. In the example shown, a first interconnecting strip 120, similar to the interconnecting strip 28 shown in FIG. 1, is connected to a second interconnecting strip 124 using connecting circuitry contained in an end cap 126. The first interconnecting strip 120 includes a plurality of LEDs 130 and the second interconnecting strip 124 includes a plurality of LEDs 132. The first and second interconnecting strips 120, 124 are identical in some embodiments, but may vary in length in other embodiments. The first interconnecting strip 120 includes conductive traces 134 that are used to drive the LEDs 130. The first interconnecting strip 120 also includes conductive traces 136, 138, and 140 that are used to drive the LEDs contained in additional interconnecting strips.

In one exemplary embodiment, the first interconnecting strip 120 further includes alternating current (AC) conducting traces 142 that are capable of conducting 115 VAC for use by additional DC power supplies and/or LED controllers. In another exemplary embodiment, the strip 120 also includes additional traces 144 that are capable of conducting serial communication traffic for use by additional DC power supplies and/or LED controllers. However, in other embodiments, the additional traces 144 are used for other purposes. The second interconnecting strip 124 includes conductive traces that correspond to those described for the first interconnecting strip 120. These include DC traces 148, 150, 152, and 154 as well as AC trace 156 and a communication trace 158. It can be appreciated that some of the traces may not be included in all embodiments.

In one exemplary embodiment, the end cap 126 promotes the completion of the circuit containing the LEDs 130 by including a looping element 146 that connects two portions of the conductive traces 134 to form a continuous circuit through the LEDs 130 when the end cap 126 is connected to the first interconnecting strip 120. The end cap 126 also includes a first conductive trace 160 that connects the conductive trace 136 to the trace 148 containing the LEDs 132, when the first interconnecting strip 120 and the second interconnecting strip 124 are connected to the end cap 126. The end cap 126 also includes conductive traces 162, 164, 166, and 168. The conductive traces 162, 164, 166, and 168 connect traces 138, 140, 142 and 144 to traces 152, 154, 156, and 158 respectively when the first and second interconnecting strips 120, 124 are connected to the end cap 126. The first and second interconnecting strips 120, 124 are directly connected to the end cap 126. However, in other embodiments, a cable or other connecting device such as the cable 32 and/or connector 34 shown in FIG. 1 are used between the end cap 126 and the first and/or second interconnecting strips 120, 124.

In typical fluorescent lighting systems, AC power is provided periodically via an electrical junction box. Each luminaire must be connected to the power source requiring numerous junction boxes and AC interface wiring. The lighting system 20 uses traces capable of carrying AC power and is advantageous because it allows one junction box to supply a whole 'string' of lights. Once a lead luminaire is connected to power, the following luminaires are daisy chained and do not require any additional wiring for AC power. They connect electrically tail-to-head, passing power down the entire string. A first AC to DC power converter is set in place and taps off an incoming 115 VAC power source. The power converter also passes the 115 VAC Power onto a first luminaire, such as the luminaire 21. Then, the first luminaire 21 connects to a second luminaire, such as the second luminaire 23, which may then be followed by third and fourth luminaires connected in sequence. When the second, third, and fourth luminaires are connected, they pass along not only the power converter's DC power and any control functions, but also communication signals and the 115 VAC input. This AC current is not used by individual luminaires, but is passed through to additional power converters that may each power an additional 'string' of luminaires. At each power converter, the 115 VAC power is again converted to usable DC light voltages.

Figure 5:
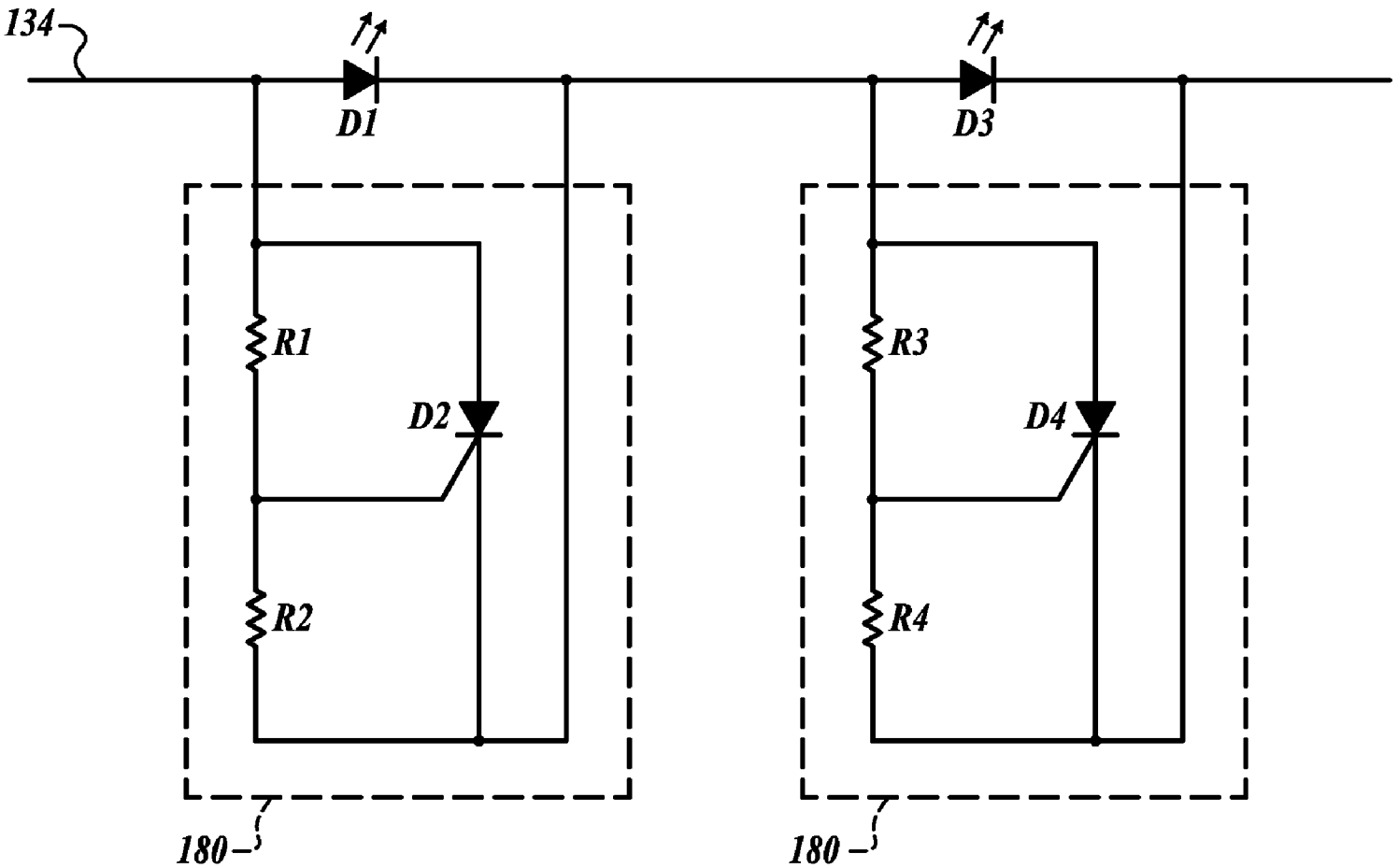
FIG. 5 is a diagram showing more detailed circuitry for the strip lighting system shown in FIG. 1.

FIG. 5 is a diagram showing more detailed circuitry for the strip lighting system 20 shown in FIG. 1. A method for allowing the current to continue to flow through a series string of LEDs is needed to prevent the entire string from going out when one LED fails open. FIG. 5 shows that a silicon controlled rectifier (SCR) thyristor circuit 180 is placed in parallel across each LED to prevent failure of the overall circuit when individual LEDs fail. Only two LEDs D1 and D3 are shown for clarity. The LEDs D1, D3 correspond to LEDs 30 and/or 130. The SCR protection circuit 180 consists of two resistors (shown as R1 and R2 in the circuit 180 in parallel with the LED D1 and as R3 and R4 in the circuit 180 in parallel with the LED D3) and an SCR thyristor (shown as D2 in the circuit 180 in parallel with the LED D1 and as D4 in the circuit 180 in parallel with the LED D3). The thyristors D2, D4 are placed in parallel with the LEDs D1, D3 respectively, as are the two resistors R1, R2 and R3, R4, respectively, which are in series with each other. The values of the resistors R1, R2, R3, R4 are selected such that the gate voltage of the thyristors D2, D4 are held below a voltage needed (typically about 0.8V) to trigger the thyristors D2, D4 when the LEDs D1, D3 are operating normally.

When the LED D1, D3 opens, voltage begins to build rapidly across the thyristor D2 or D4 respectively and the resistors R1, R2 or R3, R4, respectively. When the voltage on the gate of the thyristor D2, D4 exceeds the trigger value, the thyristor D2, D4 begins to conduct and latches itself on. It will remain in the on state until the current through the string is removed, thus completing the circuit for the remaining LEDs in the string. Once current is removed, the thyristor D2, D4 will turn off. The cycle will repeat when voltage is again applied to the LED string.

An additional benefit to using the thyristor circuit 180 is also realized in LED fault detection. Previous implementations have used Zener diodes in parallel with LEDs to conduct the current if the LED should fail. If a fault detection circuit is being used, it must check for both an open and a short condition on the LED. If the LED opens, the Zener will conduct (and the Zener must be set for a higher voltage, else it will conduct and the LED will not illuminate) and give a higher than expected voltage drop which can be detected by monitoring circuitry. If the LED shorts, the monitoring circuitry must detect a lower than expected voltage across the LED. However, with the thyristor circuit 180, only a short condition must be checked since when the LED D1, D3 opens, the thyristor D2, D4 conducts at a significantly lower voltage than an LED in normal operation.

While the preferred embodiment of the invention has been illustrated and described, as noted above, many changes can be made without departing from the spirit and scope of the invention. For example, additional components may be included within the elongated fixtures such as temperature and/or optical sensors that produce signals sent to external controllers over traces included in the interconnecting strip. These additional components would be used to provide feedback to modify and/or amend the output intensity of the solid-state lighting devices. Also, luminaires may be connected together using cables that connect to an end cap on each luminaire rather than by using a single daisy-chaining end cap between two luminaires. In another embodiment, multiple shorter strings of serial LEDs could be implemented on one interconnecting strip as long additional traces or circuits were available for return currents (effectively operating parallel groups of shorter serial LED strings). Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A solid-state light emitting device strip lighting system comprising:

a first elongated fixture;

a reflector;

an interconnecting strip including a plurality of solid-state light emitting devices electrically connected in series, the strip disposed along the length of the first elongated fixture;

a first end cap attached to a first end of the first elongated fixture, the first end cap including a first electrical connector, wherein the first electrical connector is electrically connected to the plurality of solid-state light emitting devices;

a second elongated fixture connected to the first end cap such that the first end cap serves as an end cap for both the first elongated fixture and the second elongated fixture; and a riser placed between an interior surface of the first elongated fixture and the strip, wherein a beam angle of the plurality of light emitting devices is adjustable based on a position of the riser, and wherein the strip includes a flex strip, the flex strip including the plurality of light emitting devices.

2. The solid-state light emitting device strip lighting system of claim 1, wherein the first elongated fixture is greater than or equal to approximately 12 inches in length.

3. The solid-state light emitting device strip lighting system of claim 1, wherein the first elongated fixture is a single component that forms the mechanical beam angle for a reflective surface on an interior surface of the component, thereby forming the reflector.

4. The solid-state light emitting device strip lighting system of claim 1, wherein the riser is placed between a floor of the interior surface of the first elongated fixture and the strip, and wherein the riser is in contact with the floor and the strip.

5. The solid-state light emitting device strip lighting system of claim 1, wherein the riser is located between a first inner side of the first elongated fixture and a second inner side of the first elongated fixture above a floor of the first elongated fixture.

6. The solid-state light emitting device strip lighting system of claim 5, wherein the first elongated fixture is formed such that at least one indentation is located above the floor of the first elongated fixture and wherein a portion of the riser fits within the at least one indentation to hold the riser in place.

7. The solid-state light emitting device strip lighting system of claim 1, wherein the first elongated fixture is formed of bent sheet metal.

8. The solid-state light emitting device strip lighting system of claim 1, wherein the first elongated fixture is formed of extruded metal.

9. The solid-state light emitting device strip lighting system of claim 1, wherein the first elongated fixture is formed of an extruded polymer material.

10. The solid-state light emitting device strip lighting system of claim 1, further comprising a cover strip above the strip including the solid-state light emitting devices, wherein the cover strip is formed of a polymer material and diffuses the light produced by the plurality of light emitting devices.

11. The LED strip lighting system of claim 1, wherein the solid-state light emitting devices are Light Emitting Diodes (LEDs).

12. The solid-state light emitting device strip lighting system of claim 1, wherein the strip including the plurality of light emitting devices includes circuitry running along the length of the strip that connects the plurality of light emitting devices together in series, and the circuitry includes silicon controlled rectifiers (SCRs) placed in parallel with each of the plurality of light emitting devices so that if one or more of the light emitting devices fail, current will continue to flow through the remaining light emitting devices.

13. The solid-state light emitting device strip lighting system of claim 12, wherein the circuitry includes at least one additional trace not connected to the plurality of LEDs, the at least one additional trace being capable of conducting a current for use in one or more additional elongated fixtures.

14. The solid-state light emitting device strip lighting system of claim 13, wherein the first end cap includes an electrically conductive looping connector for connecting a first portion and a second portion of the series circuit.

15. The solid-state light emitting device strip lighting system of claim 14, wherein the first end cap includes an electrically conductive power connector for connecting at least one of the additional traces capable of conducting a current for use in the additional elongated fixtures from the first elongated fixture to one or more additional elongated fixtures.

16. The solid-state light emitting device strip lighting system of claim 1, wherein the flex strip is a flex circuit.

17. The solid-state light emitting device strip lighting system of claim 16, wherein the flex circuit is a polyethylene naphthalate flex circuit.

* * * * *

UNITED STATES PATENT AND TRADEMARK OFFICE

CERTIFICATE OF CORRECTION

PATENT NO. : 7,658,509 B2
APPLICATION NO. : 11/559692
DATED : February 9, 2010
INVENTOR(S) : Summers et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 124 days.

Signed and Sealed this

Thirtieth Day of November, 2010

David J. Kappos

David J. Kappos
*Director of the United States Patent and Trademark Office*